US012185827B2

(12) United States Patent
Kim et al.

(10) Patent No.: US 12,185,827 B2
(45) Date of Patent: Jan. 7, 2025

(54) BODY CLEANSER

(71) Applicant: LG ELECTRONICS INC., Seoul (KR)

(72) Inventors: Woohyun Kim, Seoul (KR); Hyoungjun Kim, Seoul (KR); Yonggeun Jin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 316 days.

(21) Appl. No.: 17/840,286

(22) Filed: Jun. 14, 2022

(65) Prior Publication Data

US 2022/0395086 A1 Dec. 15, 2022

(30) Foreign Application Priority Data

Jun. 15, 2021 (KR) ..... 10-2021-0077560

(51) Int. Cl.
*A47K 7/00* (2006.01)
*A46B 5/00* (2006.01)
(Continued)

(52) U.S. Cl.
CPC ..... *A46B 13/023* (2013.01); *A46B 5/0095* (2013.01); *A46B 13/008* (2013.01);
(Continued)

(58) Field of Classification Search
CPC . A45D 44/02; A47K 7/00; A47K 7/02; A46B 13/02
See application file for complete search history.

(56) References Cited

U.S. PATENT DOCUMENTS 10,531,729 B1 * 1/2020 Liu ..... A46B 7/042
11,471,364 B2 * 10/2022 Rodan ..... A45D 26/0004
(Continued)

FOREIGN PATENT DOCUMENTS

CN 108024621 5/2018
CN 208463913 2/2019
(Continued)

OTHER PUBLICATIONS

The State Intellectual Property Office of the People's Republic of China Application Serial No. 202210637986.8, Office Action dated May 20, 2023, 8 pages.
(Continued)

*Primary Examiner* — Michael D Jennings
(74) *Attorney, Agent, or Firm* — LEE, HONG, DEGERMAN, KANG & WAIMEY

(57) ABSTRACT

A skin cleaner includes a case configured to form an accommodation space therein; a bracket configured to be accommodated in the accommodation space; a rotor configured to be rotatably disposed on the bracket; a rotation mechanism configured to be accommodated in the accommodation space and to rotate the rotor; an ultrasonic head configured to be disposed on the bracket and having a built-in ultrasonic vibrator therein; a vibration motor configured to be accommodated in the accommodation space and to vibrate the bracket; a plurality of brush units having magnets disposed on a surface facing the case and configured to be selectively disposed on the rotor; and a sensor configured to be accommodated in the accommodation space and to detect the magnet.

12 Claims, 11 Drawing Sheets

(51) Int. Cl.

| | |
|---|---|
| ***A46B 13/00*** | (2006.01) |
| ***A46B 13/02*** | (2006.01) |
| ***A46B 15/00*** | (2006.01) |
| ***A46D 1/00*** | (2006.01) |
| ***A47K 7/04*** | (2006.01) |

(52) U.S. Cl.
CPC ..... *A46B 15/0004* (2013.01); *A46D 1/0207* (2013.01); *A47K 7/04* (2013.01); *A46B 2200/1006* (2013.01)

(56) References Cited

U.S. PATENT DOCUMENTS

| | | | | |
|---|---|---|---|---|
| 2011/0262645 | A1* | 10/2011 | Batchvarova | D04H 1/488 427/289 |
| 2014/0100589 | A1* | 4/2014 | Gordon | B08B 1/143 606/131 |
| 2014/0142472 | A1 | 5/2014 | Giraud et al. | |
| 2015/0333609 | A1* | 11/2015 | Lattanzi | H02K 1/34 310/38 |
| 2015/0359324 | A1* | 12/2015 | Brewer | A46B 15/001 15/160 |
| 2016/0037902 | A1* | 2/2016 | Grez | A46B 5/0025 15/22.1 |
| 2017/0042386 | A1* | 2/2017 | Shokoohi | A46B 13/02 |
| 2017/0049278 | A1 | 2/2017 | Thomassen | |
| 2018/0092449 | A1* | 4/2018 | Straka | A45D 34/042 |
| 2018/0279762 | A1* | 10/2018 | Park | A46B 15/0026 |
| 2020/0000293 | A1* | 1/2020 | Akridge | A46B 9/005 |
| 2021/0113032 | A1* | 4/2021 | Karas | A47K 7/02 |
| 2021/0153638 | A1 | 5/2021 | Jeong et al. | |
| 2021/0196035 | A1* | 7/2021 | Simon | A46B 3/22 |
| 2021/0393088 | A1* | 12/2021 | Roden, II | A46B 15/0051 |
| 2022/0120065 | A1* | 4/2022 | Lin | A47K 3/28 |

FOREIGN PATENT DOCUMENTS

| | | |
|---|---|---|
| DE | 202017104292 | 10/2017 |
| DE | 202019101592 | 4/2019 |
| JP | 2009082377 | 4/2009 |
| JP | 2019025310 | 2/2019 |
| KR | 10-2015-0086512 | 7/2015 |
| KR | 20160017540 | 2/2016 |
| KR | 10-2017-0099518 | 9/2017 |
| KR | 10-1823290 | 1/2018 |
| KR | 10-1852410 | 4/2018 |
| KR | 101848623 | 4/2018 |
| KR | 102259865 | 6/2021 |

OTHER PUBLICATIONS

Korean Intellectual Property Office Application No. 10-2021-0146097, Office Action dated Apr. 5, 2024, 7 pages.

* cited by examiner

BODY CLEANSER

CROSS-REFERENCE TO RELATED APPLICATIONS

Pursuant to 35 U.S.C. § 119(a), this application claims the benefit of earlier filing date and right of priority to Korean Patent Application No. 10-2021-0077560, filed Jun. 15, 2021, the contents of which are hereby incorporated by reference herein in its entirety.

BACKGROUND OF THE INVENTION

1. Field of the Invention

The present disclosure relates to a body cleanser, and more particularly, to a body cleansing device capable of supplying ultrasonic waves and vibrations to a user.

2. Discussion of the Related Art

A body cleanser is a product used to clean the face or body, and an example of a body cleanser may be a body cleansing device that can clean the skin of the body using cream, liquid soap, foam, cleansing oil, or the like (hereinafter referred to as moisture).

The body cleanser may include a contact member (for example, a brush) that is in contact with moisture present on the skin.

The body cleanser may include a case configured to accommodate a substrate, a battery, or the like, and a brush configured to be in contact with the skin, and the case is made of plastic or metal to protect the components accommodated therein, and as an example of the brush, a plurality of contact parts are formed.

An example of a body cleanser having a brush is a skin cleanser disclosed in Korean Patent Application Laid-Open No. 10-2017-0099518 A (published on Sep. 1, 2017), and the skin cleanser includes a main body part which is manipulated and used by a user while holding the main body part by the hand of the user; and a contact part installed at one end part of the main body part and provided with a movable brush to contact the skin, wherein the contact part changes the contact area according to the curved contour of the skin to perform a skin cleaning or massage function and thus, according to a user's selective operation to perform, the plurality of contact parts are configured to be capable of protruding in multiple stages on the concentric axis.

As another example of a device having a brush, there is a skin care device disclosed in Korean Patent No. 10-1852410 B1 (published on Apr. 27, 2018), and the skin care device includes a head part that can be in contact with a user's skin; a battery for supplying power to the head part; a body part having a fastening part to which the head part is fastened at one end and having the battery therein; and a cap assembly detachably attached to one end of the body part and forming an accommodation space for accommodating the head part, wherein the head part includes a contact probe which is in contact with the user's skin, and on which positive or negative ions are formed on the surface according to the operation mode of the skin care device; an ultrasonic resonator configured to transmit ultrasonic vibrations into the user's skin; and a vibration motor configured to vibrate the contact probe to transmit vibration to the skin.

SUMMARY OF THE INVENTION

An object of the present disclosure is to provide a body cleanser which can satisfy various requirements of consumers with one device.

A skin cleaner according to the present embodiment may include a case configured to form an accommodation space therein; a bracket configured to be accommodated in the accommodation space; a rotor configured to be rotatably disposed on the bracket; a rotation mechanism configured to be accommodated in the accommodation space and to rotate the rotor; an ultrasonic head configured to be disposed on the bracket and having a built-in ultrasonic vibrator therein; a vibration motor configured to be accommodated in the accommodation space and to vibrate the bracket; a plurality of brush units having magnets disposed on a surface facing the case and configured to be selectively disposed on the rotor; and a sensor configured to be accommodated in the accommodation space and to detect the magnet.

The ultrasonic head may include a head, and a housing coupled to the head and having a space in which the ultrasonic vibrator is accommodated.

The ultrasonic head may further include a head sealing member disposed on at least one of the head and the housing to seal the space between the head and the housing.

The ultrasonic head may further include a housing sealing member configured to be disposed on the housing and to seal between the housing and the bracket.

The body cleanser may further include a bracket sealing member configured to be disposed on the bracket to seal a portion between the housing and the bracket.

The case may include a first case configured to face the brush unit coupled to the rotor, and a second case configured to be coupled to the first case and to be provided with a handle.

The body cleanser may further include a case sealing member configured to be disposed on at least one of the first case and the bracket to seal a portion between the first case and the bracket.

The rotation mechanism may include a power transmission gear meshed with a driven gear formed on the rotor; a rotation shaft connected to the power transmission gear, and a rotation motor configured to be rotate the power transmission gear.

The bracket may have an opening through which the rotation shaft passes.

The body cleanser may further include a rotation shaft sealing member disposed between the rotation shaft and the opening to seal a portion between the rotation shaft and the opening.

The plurality of brush units may include a cleaning brush. The cleaning brush may include a brush bracket in which the magnet is disposed on an upper surface thereof and in which a coupling part coupled to the rotor is formed, and a silicone brush configured to cover the lower surface of the brush bracket. At the center of the brush bracket and the center of the silicon brush, openings surrounding the outer peripheral surface of the ultrasonic head may be formed, respectively.

The plurality of brush units may include a regular bristle brush. The regular bristle brush may include a brush bracket on which the magnet is disposed on an upper surface thereof, on which a coupling part coupled to the rotor is formed, and which covers the ultrasonic head; and a fine bristle brush configured to cover the lower surface of the brush bracket.

The plurality of brush units may include a glass brush. The glass brush may include a brush bracket on which the magnet is disposed on an upper surface thereof, on which a coupling part coupled to the rotor is formed, and which covers the ultrasonic head, and a glass configured to cover a lower surface of the brush bracket and having at least one of a groove part and a hole part.

The plurality of brush units may have different types of magnets, and the sensor may be a hall sensor disposed on the inner surface of the case.

The plurality of brush units may include a cleaning brush having a silicone brush and having an opening surrounding the outer peripheral surface of the ultrasonic head, a regular bristle brush having a fine bristle brush, and a glass brush having a glass.

The body cleanser may include a controller for controlling a vibration motor, an ultrasonic vibrator, and a rotating mechanism.

The controller may operate the vibration motor and the ultrasonic vibrator when the cleaning brush is mounted.

The controller may operate the rotation mechanism when the regular bristle brush or the glass brush is mounted.

According to an embodiment of the present disclosure, a unit of the plurality of brush units are mounted and vibration and ultrasonic waves are applied to the skin to manage skin texture/dead skin cells with deep cleansing, and another unit of the plurality of brush units is mounted and with rotating cleansing, it is possible to manage dead skin cells of elbows, heels, or the like.

In addition, vibration and ultrasonic waves are applied to the skin through the silicone brush to enable gentle cleansing, and by replacing the silicone brush with a regular bristle brush or a glass brush, dead skin cells can be conveniently and easily removed.

In addition, a plurality of brush units suitable for cleansing purposes are provided, and the operation of the body cleanser is different for each mounted brush unit, so that an optimal body cleansing effect can be expected.

In addition, the head sealing member can minimize the penetration of moisture between the head and the housing, and it is possible to minimize the penetration of moisture into the ultrasonic vibrator.

In addition, the housing sealing member or the bracket sealing member can minimize the settling of moisture between the housing and the bracket and can minimize the penetration of moisture into the vibration motor, the rotating machine, or the like.

In addition, the case sealing member can minimize the penetration of moisture between the first case and the bracket and can protect the various parts inside the accommodation space as much as possible.

In addition, the rotation shaft sealing member can minimize the penetration of moisture to the rotation motor, or the like which can minimize penetration of moisture to the rotation shaft, the opening of the bracket, and the rotation shaft.

In addition, when the cleaning brush is mounted, the ultrasonic head located at the center of the cleaning brush can apply vibration and ultrasonic waves to the skin, and the cleaning brush can apply vibration to the skin around the ultrasonic head to manage dead skin cells and skin texture using deep cleansing.

In addition, when the regular bristle brush is mounted, the regular bristle brush can cover the ultrasonic head to protect the ultrasonic head, and it is possible to minimize the penetration of dead skin cells or the like separated from the skin between the rotor and the ultrasonic head, so that the body cleanser can be kept to be clean.

In addition, when the glass brush is mounted, the glass brush can cover the ultrasonic head to protect the ultrasonic head, and it is possible to minimize the penetration of dead skin cells or the like separated from the skin between the rotor and the ultrasonic head, so that the body cleanser can be kept to be clean.

DETAILED DESCRIPTION OF THE PREFERRED EMBODIMENTS

Figure 1:
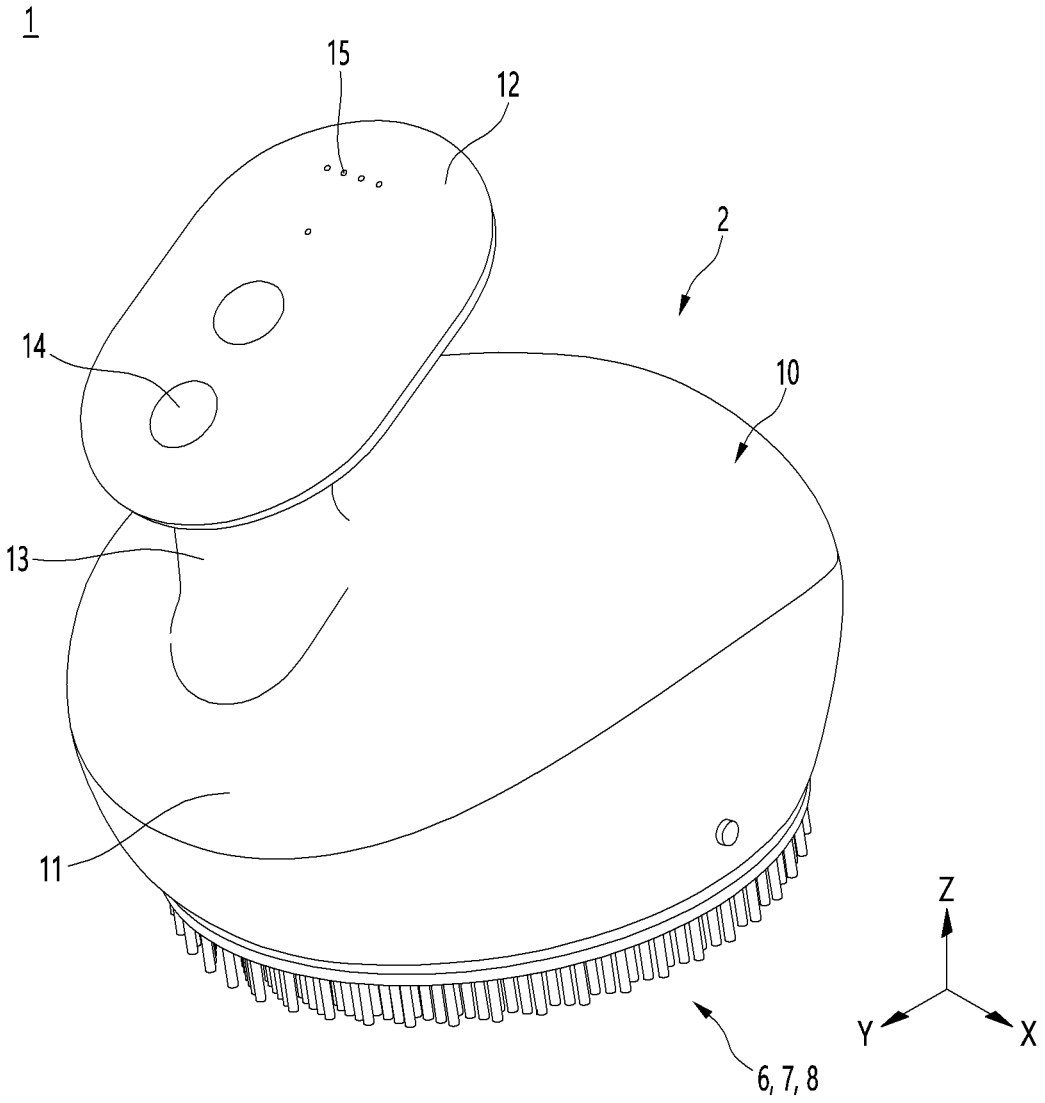
FIG. 1 is a perspective view illustrating a body cleanser according to the present embodiment.

Hereinafter, detailed embodiments will be described in detail with reference to the accompanying drawings.

Hereinafter, the embodiments disclosed herein will be described in detail with reference to the accompanying drawings, and the same or similar elements are designated with the same reference numbers regardless of the drawing numbers in the drawings and their redundant description will be omitted. The suffixes "module" and "portion" for components used in the following description are given or mixed in consideration of the ease of writing the specification, and thus they do not have distinct meaning or roles by themselves.

In addition, when it is determined that the detailed description of the related known technology may obscure the subject matter of embodiments disclosed herein in describing the embodiments, a detailed description thereof will be omitted. Further, the accompanying drawings are intended to facilitate understanding of the embodiments disclosed herein, and the technical spirit disclosed herein is not limited by the accompanying drawings. Therefore, the present disclosure should be construed as including all the changes, equivalents to substitutions included in the spirit and the technical scope of the present disclosure.

Terms including an ordinal number, such as first, second, or the like, may be used to describe various components, but the components are not limited by the terms. The above terms are used only for the purpose of distinguishing one component from another.

When a component is referred to as being "connected" or "accessed" to another component, it may be directly connected or accessed to the other component, but it is understood that other components may exist in between.

The singular expression includes the plural expression unless the context clearly dictates otherwise.

In the present application, terms such as "comprises" or "have" are intended to designate that the features, numbers, steps, operations, components, parts, or combinations thereof described in the specification exist, but it is to be understood that this does not preclude the possibility of addition or existence of one or more other features, numbers, steps, operations, components, parts, or combinations thereof.

Figure 2:
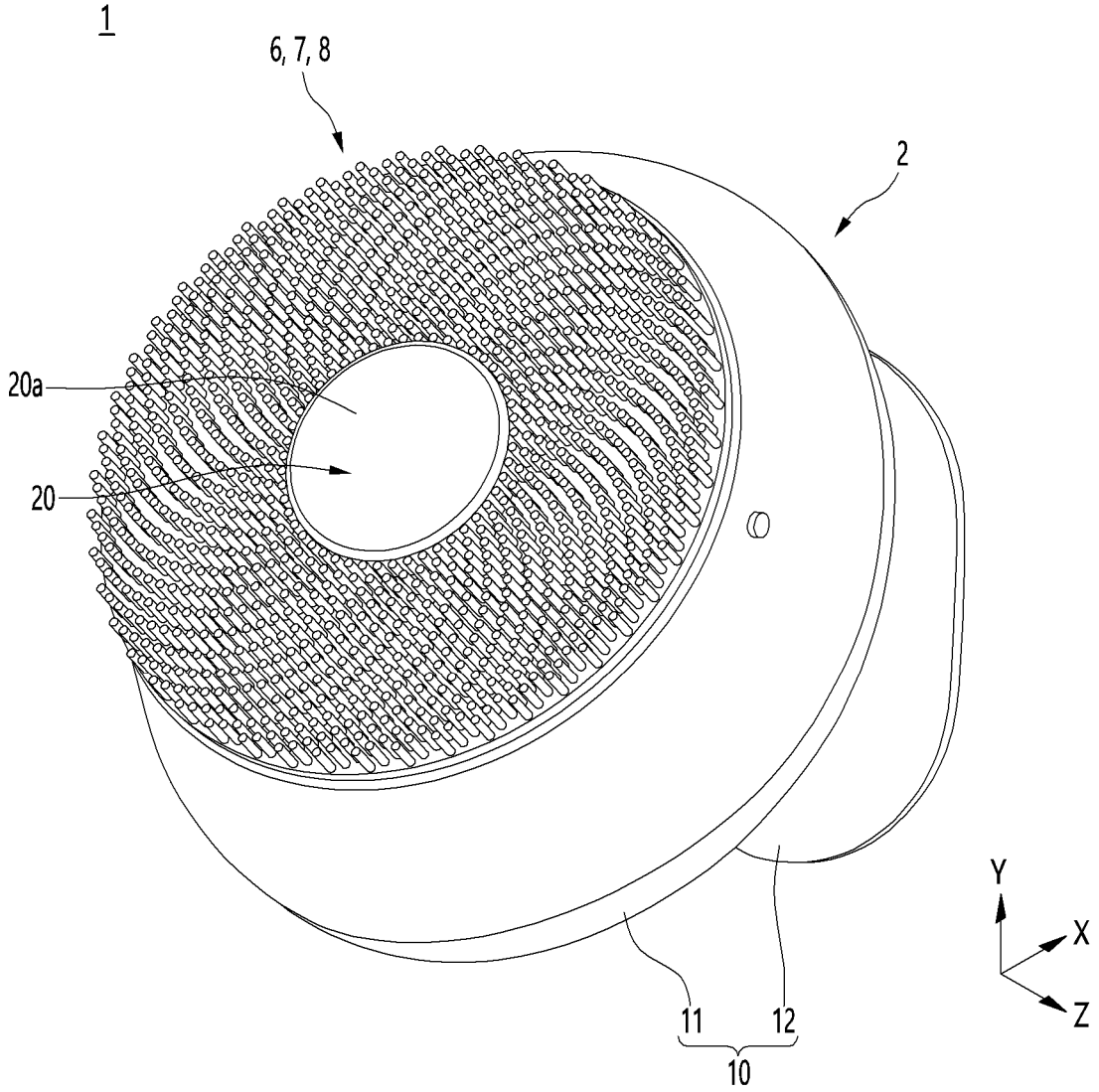
FIG. 2 is a view illustrating a brush unit according to the present embodiment.

FIG. 1 is a perspective view illustrating a body cleanser according to the present embodiment, and FIG. 2 is a view illustrating a brush unit according to the present embodiment.

As illustrated in FIGS. 1 and 2, the body cleanser 1 may include a cleanser main body 2 and brush units 6, 7, and 8 detachably mounted to the cleanser main body 2.

The cleanser main body 2 may include a case 10 forming an outer appearance and an ultrasonic head 20 (refer to FIG. 2).

The case 10 may include a body part 11 and a manipulation part 12 formed on an upper side of the body part 11.

The body part 11 may have an accommodation space therein. A neck part 13 may be formed to protrude from an upper part of the body part 11.

The manipulation part 12 may be formed on an upper part of the neck part 13 and may be formed to be larger than the neck part 13.

The manipulation part 12 may be spaced apart from the body part 11, and the manipulation part 12 may be a handle for the user to hold the body cleanser 1 by hand. A button 14 for inputting a command and an indicator 15 for expressing information about the body cleanser 1 may be disposed on the operation part 12, and the user inputs the button 14 to be capable of manipulating the body cleanser 1.

As illustrated in FIG. 2, the ultrasonic head 20 may be partially exposed to the outside of the case 10. The lower surface 20*a* of the ultrasonic head 20 may be exposed to the outside of the case 10 and may be a contact surface in contact with the user's skin.

The ultrasonic head 20 may be in contact with the user's skin, the ultrasonic head 20 may apply at least one of ultrasonic waves and vibrations to the user's skin, and the cleansing effect using the body cleanser 1 may be improved.

A plurality of brush units 6, 7, and 8 may be selectively disposed, and the user selects one of the plurality of brush units 6, 7, and 8 and can use the body cleanser 1 in a state where the brush unit is coupled to the cleanser main body 2.

The brush units 6, 7, and 8 may be coupled to the cleanser main body 2 so as to be positioned below the cleanser main body 2.

A plurality of brush units 6, 7, and 8 are not coupled to the cleanser main body 2 together, and one selected by the user may be coupled to the cleanser main body 2 and used.

The plurality of brush units 6, 7, and 8 may be replaceable brush units, and may be selectively used according to a part of the user's skin to be cared for.

Figure 3:
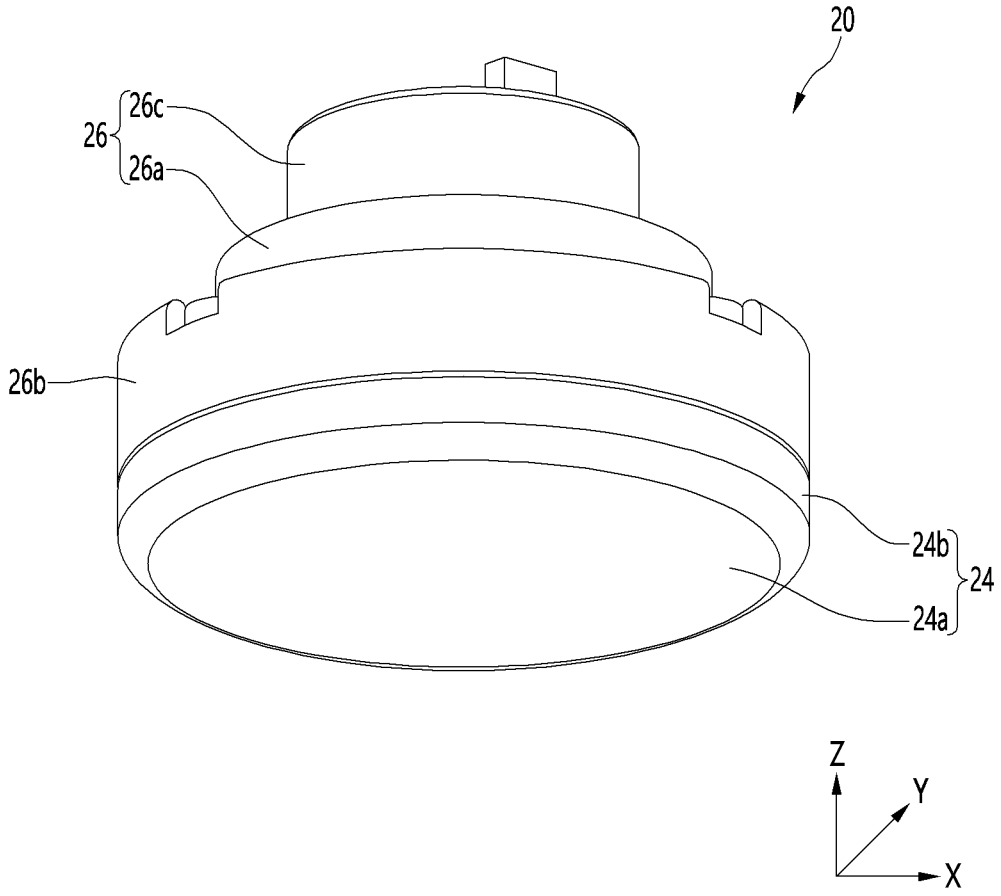
FIG. 3 is a perspective view illustrating an ultrasonic brush according to an embodiment.
Figure 4:
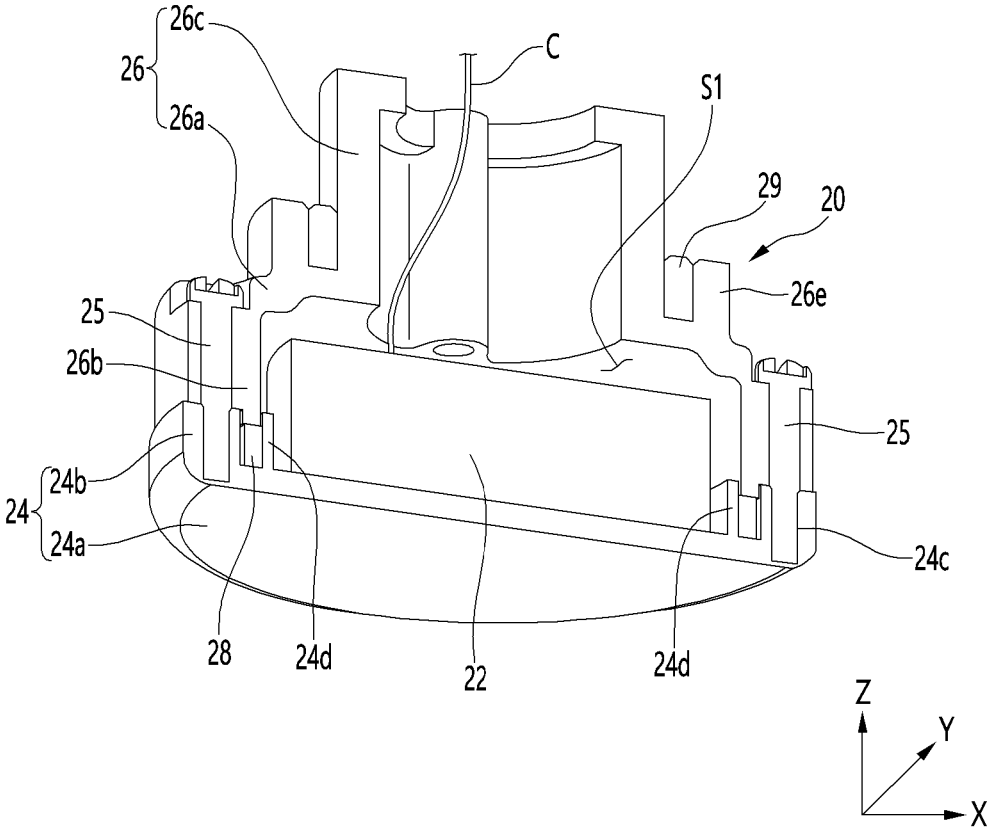
FIG. 4 is a partially cut-away perspective view illustrating the ultrasonic brush according to an embodiment.

FIG. 3 is a perspective view illustrating an ultrasonic brush according to an embodiment, and FIG. 4 is a partially cut-away perspective view illustrating the ultrasonic brush according to an embodiment.

The ultrasonic head 20 may include an ultrasonic vibrator 22 as illustrated in FIG. 4. The ultrasonic vibrator 22 may be built into the ultrasonic head 20.

The ultrasonic vibrator 22 may be an ultrasonic generator that generates ultrasonic waves.

The ultrasonic head 20 may further include a head 24 that is in contact with the user's skin, and a housing 26.

The head 24 may be in contact with the user's skin, and the ultrasonic vibrator 22 may be disposed on the head 24 to make the head 24 ultrasonically vibrate.

The head 24 in contact with the user's skin may be formed of a material such as SUS, and may be SUS316L as an example.

The lower surface of the head 24 may be the lower surface 20*a* of the ultrasonic head 20 (refer to FIG. 2). The head 24 may include a lower plate part 24*a* and a peripheral part 24*b*.

The lower plate part 24*a* may have a disk shape, and the lower surface thereof may be the lower surface 20*a* of the ultrasonic header 20. When the user brings the body cleanser 1 into contact with the user's skin, the lower plate part 24*a* may be in contact with a large contact area.

The peripheral part 24*b* protrudes upward from the outer periphery of the lower plate part 24*a*. The peripheral part 24*b* may have a substantially ring shape or a hollow cylindrical shape.

A fastening part 24*c* that can be fastened to the housing 26 and a fastening member 25 such as a screw may be formed in the head 24.

The fastening part 24*c* may be formed in the peripheral part 24*b*.

A plurality of fastening parts 24*c* may be provided on the head 24, and the head 24 and the housing 26 may be firmly coupled by a plurality of fastening members 25.

The housing 26 may be coupled to the head 24 and may be formed of an injection product or a molded product from synthetic resin or the like.

Only the head 24 of the ultrasonic head 20 that comes into contact with the skin is molded of SUS material, and the housing 26 may be molded of an injection material that is lighter than the SUS material. In this case, the head 24 and the housing 26 may be lower in weight than when all of them are made of SUS material.

The housing 26 may protect the ultrasonic vibrator 22 from the upper side of the head 24.

A space S1 in which the ultrasonic vibrator 22 is accommodated may be formed in the housing 26. The housing 26 may include a housing part 26*a*. The housing part 26*a* may have an open bottom surface, and a space S1 in which the ultrasonic vibrator 22 is accommodated may be formed in the housing part 26*b*.

The housing part 26*a* may include a peripheral part 26*b*. A fastening member through-hole through which the fastening member 25 such as a screw passes may be formed in the peripheral part 26*b*.

The housing 26 may include a peripheral part 26*c* and a separate through-part 26*c*. The cable C connected to the ultrasonic vibrator 22 may pass through the through-part 26*c*. The through-part 26*c* may have a substantially hollow cylindrical shape.

The through-part 26*b* may extend upward from the housing part 26*b* and the cable C connected to the ultrasonic vibrator 22 may pass through the through-part 26*b* to extend upward of the ultrasonic head 20.

The ultrasonic head 20 may further include a head sealing member 28.

The head sealing member 28 may be disposed on at least one of the head 24 and the housing 26. The head sealing member 28 may seal between the head 24 and the housing 26. An example of the head sealing member 28 may be a waterproof O-ring, and the ultrasonic head 20 may have a waterproof structure using an O-ring.

The ultrasonic head 20 may be formed with a head sealing member accommodation part 24*d* in which the head sealing member 28 is accommodated.

The head sealing member accommodation part 24*d* may be formed in at least one of the head 24 and the housing 26.

The head sealing member accommodation part 24*d* may be formed inside the peripheral part 24*b* of the head 24.

The head sealing member 28 accommodated in the head sealing member accommodation part 24*d* may be protected by the peripheral part 24*b* from the inside of the peripheral part 24*b* and the fastening part 24*c*.

When the head 24 and the housing 26 are coupled, the upper end of the head sealing member 28 accommodated in the head sealing member accommodation part 24*d* may be in contact with the lower end of the peripheral part 26*b* of the housing 26.

Moisture is blocked by the head sealing member 28, and, through a portion between the peripheral part 26*b* of the housing 26 and the peripheral part 24*b* of the head 24, penetration of the moisture into the inside of the ultrasonic head 20, that is, into the space S1 may be minimized.

In other words, the head sealing member 28 can minimize the flow of moisture to the ultrasonic vibrator 22, and the ultrasonic vibrator 22 can ultrasonically vibrate the head 24 with high reliability.

Figure 5:
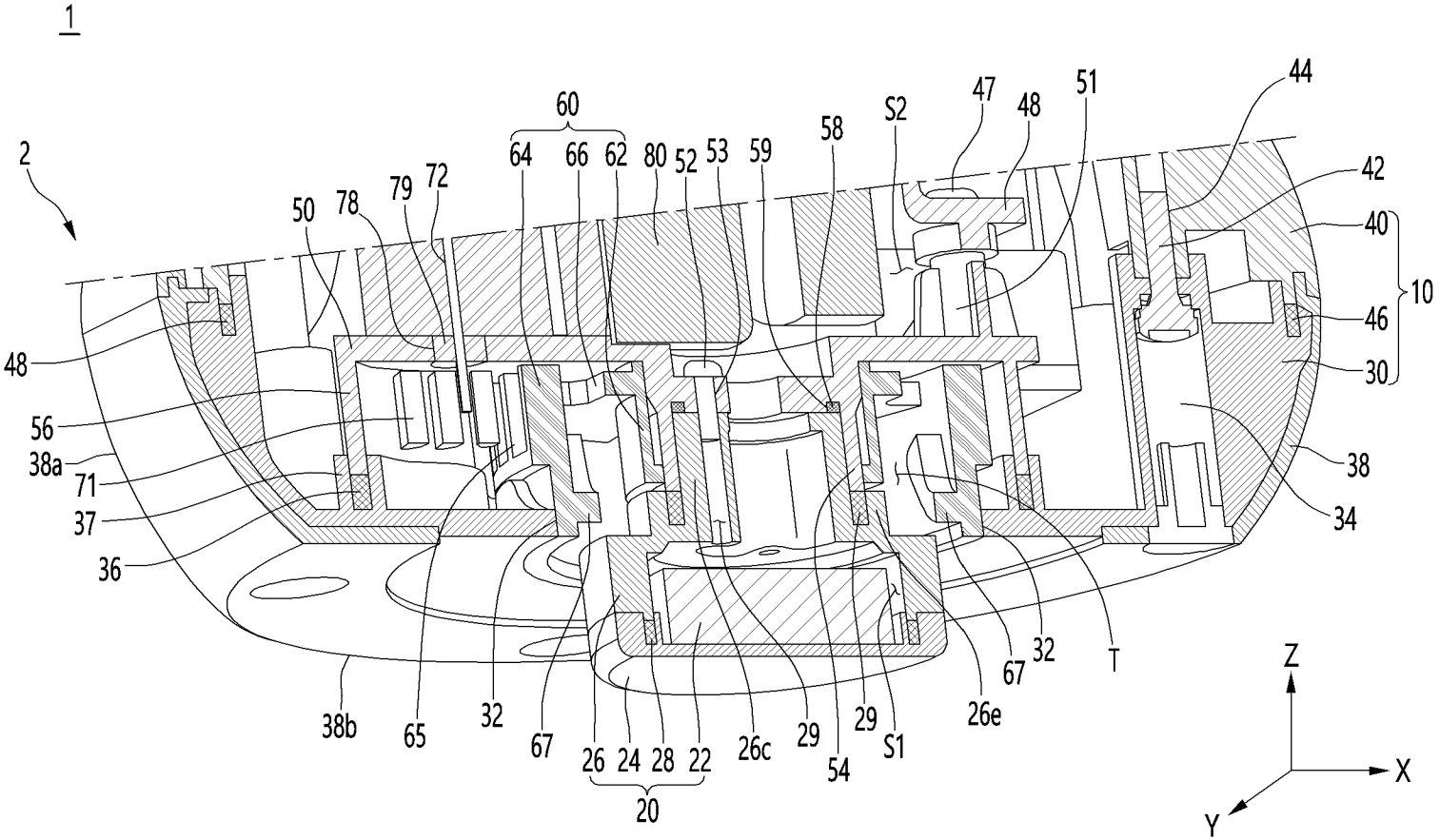
FIG. 5 is a partially cut-away perspective view illustrating the inside of the body cleanser according to the present embodiment.
Figure 6:
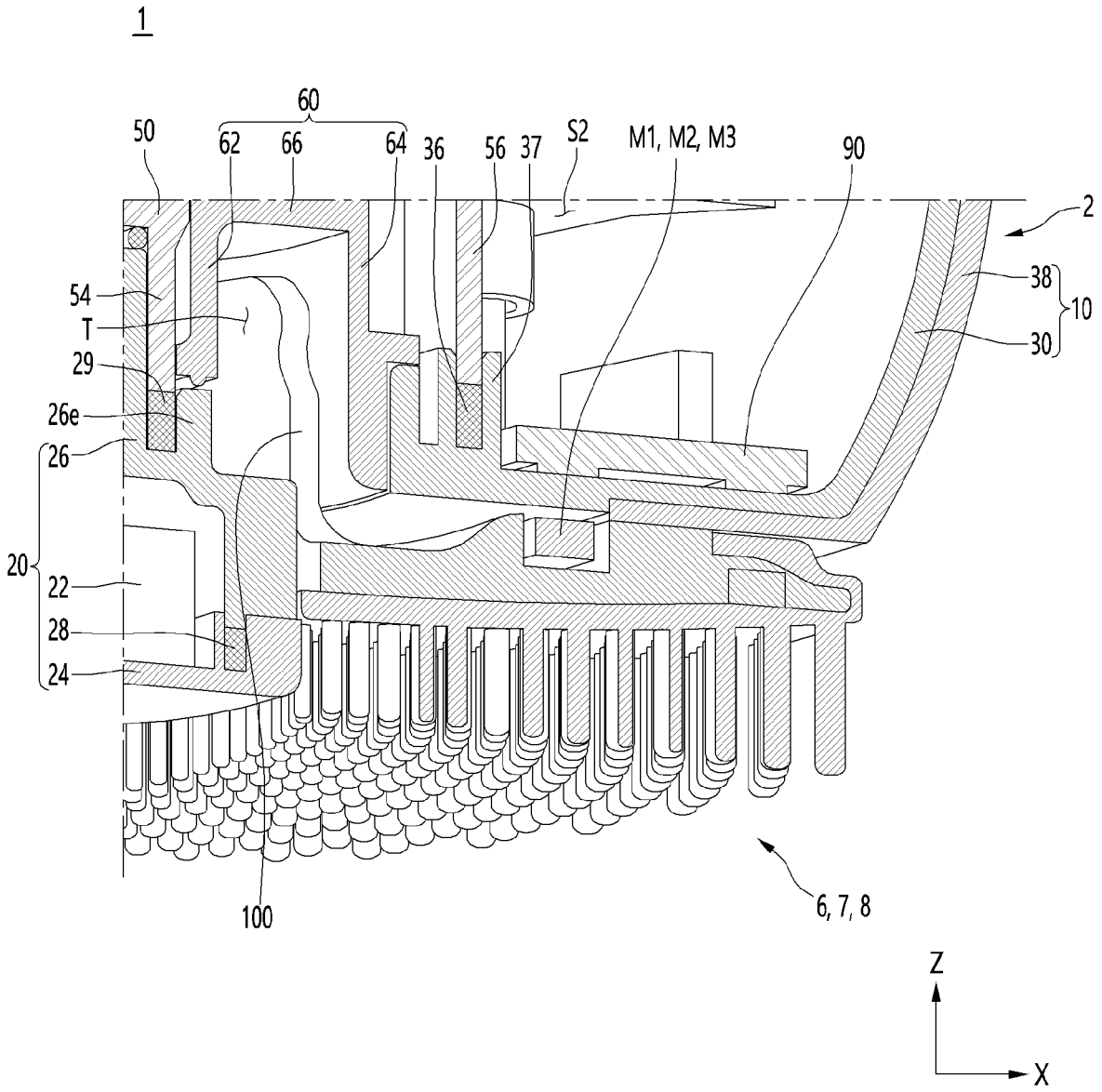
FIG. 6 is a partially cut-away perspective view when the brush unit according to an embodiment is mounted.
Figure 7:
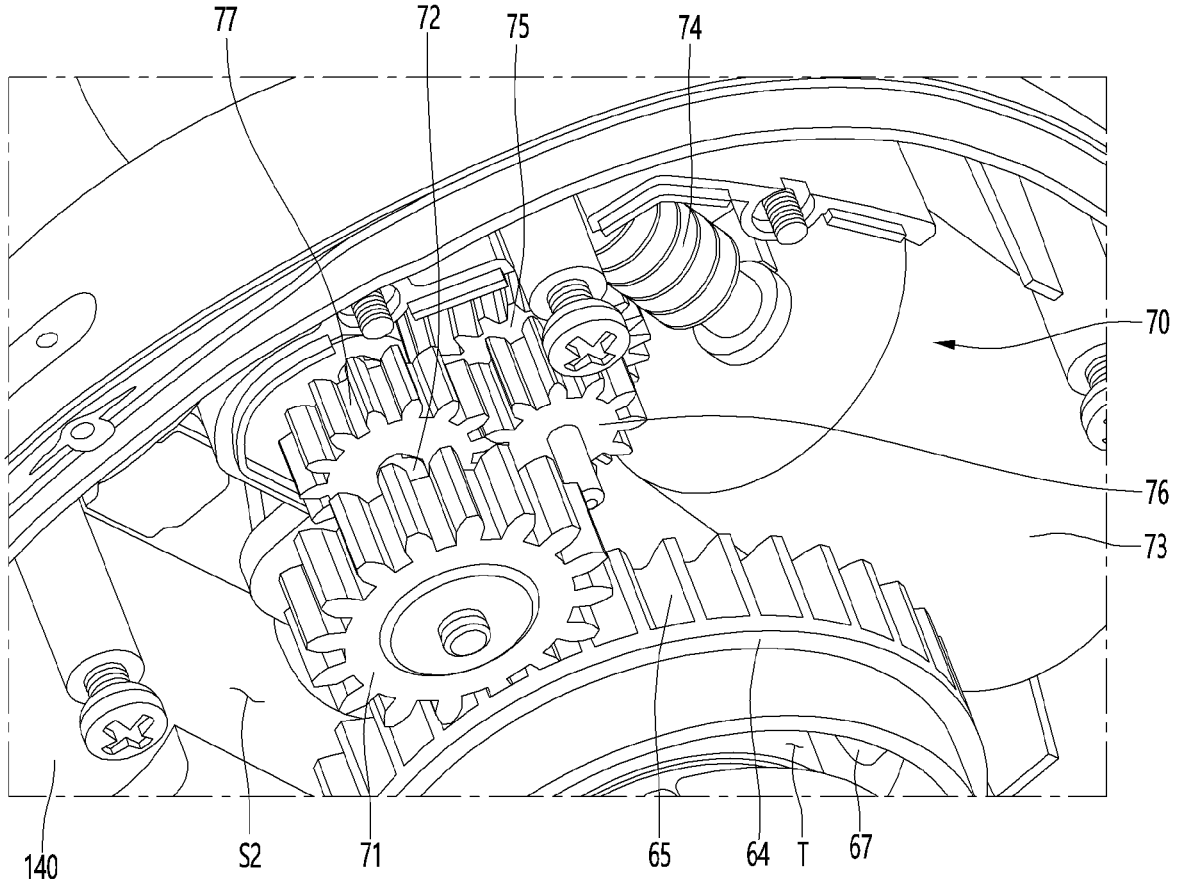
FIG. 7 is a perspective view illustrating a rotation mechanism according to the present embodiment.

FIG. 5 is a partially cut-away perspective view illustrating the inside of the body cleanser according to the present embodiment, FIG. 6 is a partially cut-away perspective view when the brush unit according to an embodiment is mounted, and FIG. 7 is a perspective view illustrating a rotation mechanism according to the present embodiment.

An accommodation space S2 may be formed inside the case 10.

The case 10 may include a first case 30 (refer to FIGS. 5 and 6) in which the brush units 6, 7, and 8 face each other, and a second case 40 (see FIG. 5) coupled to the first case 30 and provided with a handle.

The accommodation space S2 may be formed between the first case 30 and the second case 40 when the first case 30 and the second case 40 are coupled to each other.

The accommodation space S2 may be divided into a lower accommodation space formed inside the first case 30 and an upper accommodation space formed inside the second case 40.

The first case 30 may be a bottom case as a reference when the brush units 6, 7, and 8 are disposed under the cleanser main body 2.

As illustrated in FIG. 5, the first case 30 may have an interior and an upper surface which are open. An opening 32 may be formed at a lower part of the first case 30. The first case 30 may constitute a part of the body part 11 (refer to FIG. 1).

The case 10 may have a through-part 34 through which a fastening member 42 such as a screw passes.

The case 10 may further include a cover 38 surrounding the outer periphery of the first case 30. The cover 38 may be made of a rubber material and may protect the first case 30 from the outside of the first case 30.

The cover 38 may include an outer cover 38*a* surrounding the outer periphery of the first case 30 and a lower cover 38*b* extending from the lower end of the outer cover 38*a* and covering a portion of the lower surface of the first case 30.

The second case 40 may be a top case as a reference when the brush units 6, 7, and 8 are disposed under the cleanser main body 2.

The second case 40 may have shape the inside part and the lower surface which are open and may constitute the rest of the body part 11, and a neck part 13 (see FIG. 1) and an manipulation part 12 can be formed on the upper part (see FIG. 1).

The first case 30 and the second case 40 may be fastened with a fastening member 42 such as a screw. A fastening part 44 to which the fastening member 42 inserted into the through part 34 is fastened may be formed in the second case 40.

The body cleanser 1 may include an outer sealing member 46.

The outer sealing member 46 may be disposed between the first case 30 and the second case 40 to seal a portion between the first case 30 and the second case 40. An example of the outer sealing member 46 may be a waterproof O-ring, and a waterproof structure using an O-ring may be applied to the case.

A bracket fastening part 48 to which a bracket 50 to be described later is fastened with a fastening member 47 such as a screw may be formed inside the second case 40. The bracket fastening part 47 may be located in the accommodation space S2. The bracket fastening part 48 may be a part of the second case 40 and may be a separate fastening body disposed inside the second case 40.

The body cleanser 1 may further include a case sealing member 36. The case sealing member 36 may be disposed on at least one of the first case 30 and the bracket 50 to be described later to seal a portion between the first case 30 and the bracket 50.

A case sealing member accommodation part 37 in which the case sealing member 36 can be accommodated may be formed inside the first case 30, and the case sealing member 36 accommodated in the case sealing member accommodation part 37 may be in contact with the outer protrusion 56 to be described later to prevent moisture from penetrating between the first case 30 and the outer protrusion 56.

An example of the case sealing member 36 may be a waterproof O-ring, and a waterproof structure using an O-ring may be applied to the first case 30 and the bracket 50.

The body cleanser 1 may include a bracket 50 accommodated in the accommodation space S2, a rotor 60 rotatably disposed in the bracket 50, a rotation mechanism 70 accommodated in the accommodation space S2 and rotating the rotor 60, and a vibration motor 80 accommodated in the accommodation space S2 and vibrating the bracket 50.

The bracket 50 is a supporter capable of supporting various parts accommodated in the accommodation space S2. The bracket 50 may be fastened to the bracket fastening part 48 with a fastening member 47 such as a screw so as to be located in the accommodation space S2. A fastening boss 51 may protrude upward from the bracket 50, and a fastening member 47 such as a screw may fasten the bracket fastening part 47 and the fastening boss 51.

An inner protrusion 54 and an outer protrusion 56 may protrude downward from the bracket 50.

The lower end of the inner protrusion 54 may contact the upper end of the housing sealing member 29.

The inner protrusion 54 may be an inner sealing body for sealing the bracket 50 and the housing 26.

The outer protrusion 54 may be located outside the inner protrusion 54.

The lower end of the outer protrusion 54 may be inserted into the case sealing member accommodation part 37 and may be in contact with the upper end of the case sealing member 36.

The outer protrusion 54 may be an outer sealing body for sealing the bracket 50 and the first case 30.

The ultrasonic head 20 may be disposed on the bracket 50. As illustrated in FIG. 5, the ultrasonic head 20 may be fastened to the bracket 50 with a fastening member 52 such as a screw.

A bracket fastening hole 29 to which a fastening member 52 such as a screw can be fastened may be formed in the housing 26 of the ultrasonic head 20, and a fastening member through-hole 53 through which a fastening member 52 such as a screw is penetrated may be formed on the bracket 50.

The bracket fastening hole 29 may be formed in the through-part 26*c* of the housing 26, and the through-part 26*c* may be fastened to the bracket 50 by a fastening member 52 such as a screw. The through-part 26*c* may be a bracket coupling part coupled to the bracket 50.

The ultrasonic head 20 may be suspended from the bracket 50 by the fastening member 52.

The ultrasonic head 20 may further include a housing sealing member 29 (refer to FIG. 5).

The housing sealing member 29 may be disposed on the housing 26 to seal a portion between the housing 26 and the bracket 50.

A housing sealing member accommodation part 26*e* in which the housing sealing member 29 can be accommodated may be formed in the housing 26, and in a state where the housing sealing member 29 is accommodated in the housing sealing member accommodation part 26*e*, the upper end of the housing sealing member 29 may be in contact with the inner protrusion 54 of the bracket 50.

The housing sealing member 29 may prevent moisture from penetrating through a portion between the housing 26 and the inner protrusion 54.

An example of the housing sealing member 29 may be a waterproof O-ring, and a waterproof structure using an O-ring may be applied to the housing 26 and the inner protrusion 54.

The body cleanser may further include a bracket sealing member 58.

The bracket sealing member 58 may be disposed on the bracket 50 to seal a portion between the housing 26 and the bracket 50.

A bracket sealing member accommodating groove 59 for receiving the bracket sealing member 58 is formed in the bracket 50, and in a state where the bracket sealing member 58 is accommodated in the bracket sealing member accommodating groove 59, the bracket sealing member 58 may be in contact with the upper end of the through-part 26*c* and may be sealed between the bracket 50 and the through-part 26*c*.

An example of the bracket sealing member 58 may be a waterproof O-ring, and a waterproof structure using an O-ring may be applied to the housing 26 and the through-part 26*c*.

The rotor 60 may be a connector to which a plurality of brush units 6, 7, and 8 are selectively coupled.

The rotor 60 may be rotatably accommodated in a portion between the bracket 50 and the ultrasonic head 20 in the vertical direction (Z).

The rotor 60 may be rotatably accommodated in a portion between the inner protrusion 54 and the outer protrusion 56 in the left and right direction (X) and the front and rear direction (Y).

The rotor 60 may be a rotation connector rotatably accommodated in a portion between the bracket 50 and the ultrasonic head 20, in particular, between the inner protrusion 54 and the outer protrusion 56.

As illustrated in FIG. 5, the rotor 60 may include an inner diameter part 62 and an outer diameter part 64, and a connection part 66 connecting the inner diameter part 62 and the outer diameter part 64.

The inner diameter part 62 may be disposed in a portion between the housing 26 of the ultrasonic head 20 and the bracket 50.

The lower end of the inner diameter part 62 may be seated in the upper sealing member accommodation part 26*e* formed in the housing 26 of the ultrasonic head 20, and the inner diameter part 62 may be supported by the housing 26.

A ring-shaped rib may be formed on the bottom surface of the inner diameter part 62, and the rib may be the lower end of the inner diameter part 62. These ribs may be seated on the upper end of the upper sealing member accommodation part 26*e* formed in the housing 26.

The inner diameter part 62 may be disposed to be elongated in the vertical direction between the housing 26 of the ultrasonic head 20 and the bracket 50. The upper end of the inner diameter part 62 may face the bracket 50.

The outer diameter part 64 may be formed larger than the inner diameter part 62 and may be formed outside the inner diameter part 62.

In a portion between the inner diameter part 62 and the outer diameter part 64, a gap T (see FIGS. 5 and 6) into which the coupling parts 100 (refer to FIG. 6) of the plurality of brush units 6, 7, and 8 are inserted can be formed.

At least one of the outer peripheral surface of the inner diameter part 62 and the inner peripheral surface of the outer diameter part 64 may be provided with a fitting part 67 to which the coupling part 100 may be detachably coupled.

The fitting part 67 may protrude toward the gap T.

Each of the fitting part 67 and the coupling part 100 may be formed in plurality in the peripheral direction, and the coupling part 100 may enter a portion between the adjacent fitting parts 67, and the selected brush unit of a plurality of brush units 6, 7, and 8 may be coupled to the rotor 60 by a plurality of coupling parts 100 and a plurality of fitting parts 67.

As illustrated in FIG. 5, a portion of the lower part of the outer diameter part 64 may be guided to the opening 32, and the rotor 60 may be rotationally guided to the first case 30.

A driven gear 65 for connecting to the rotation mechanism 70 (see FIG. 7) may be formed on the outer peripheral surface of the outer diameter part 64.

The rotation mechanism 70 may include a power transmission gear 71 meshed with a driven gear 65 formed in the rotor 60, and a rotation shaft 72 connected to the power transmission gear 71.

The power transmission gear 71 may be located next to the rotor 60 and may rotate the rotor 60 from the side of the rotor 60.

The rotation shaft 72 may be a rotation center of the power transmission gear 71 and may extend above the power transmission gear 71.

The rotation mechanism 70 may include a rotation motor 73 for rotating the power transmission gear 71. The rotation mechanism 70 may include a driving gear 74 capable of transmitting the driving force of the rotating motor 73 to the rotation shaft 72, and a plurality of intermediate gears 75, 76, and 77.

The driving gear 74 may be connected to the shaft of the rotation motor 73, and may be, for example, a worm gear.

The plurality of intermediate gears 75, 76, and 77 are, as illustrated in FIG. 7, may include a large gear 75 to which the driving gear 74 is meshed, a small gear 76 integrally formed with the large gear 75, and an upper gear 77 meshed with the small gear 76, positioned above the power transmission gear 71, and connected to the rotation shaft 72.

As illustrated in FIG. 5, the rotation shaft 72 may pass through the bracket 50, and an opening 78 (see FIG. 5) through which the rotation shaft 72 passes may be formed in the bracket 50.

A portion positioned between the upper gear 77 and the power transmission gear 71 of the rotation shaft 72 may pass through the opening 78.

The body cleanser may further include a rotation shaft sealing member 79 (refer to FIG. 5).

The rotation shaft sealing member 79 may be disposed between the rotation shaft 72 and the opening 78 and may seal between the rotation shaft 72 and the opening 78, and it is possible to prevent moisture from penetrating into the accommodation space S2 through the opening 78.

An example of the rotation shaft sealing member 79 may be a waterproof O-ring, and the rotation shaft 72 and the bracket 50 may have a waterproof structure using an O-ring.

As illustrated in FIG. 5, the vibration motor 80 may be accommodated in the accommodation space S2 to be positioned on the upper side of the bracket 50.

Meanwhile, the plurality of brush units 6, 7, and 8 may be selectively disposed on the rotor 60, and each of the plurality of brush units 6, 7, and 8 may have magnets M1, M2, and M3 disposed on the surface facing the case 10.

The body cleanser 1 may include a sensor 90 (refer to FIG. 6) that is accommodated in the accommodation space S2 and detects the magnet M. The sensor 90 may be a Hall sensor disposed on the inner surface of the case 20. The Hall sensor may be accommodated in the accommodation space S2 and may be protected by the case 10.

As illustrated in FIG. 7, the battery 140 may be accommodated in the accommodation space S2 and may be disposed adjacent to the rotation mechanism 70 of the battery 140.

Figure 8:
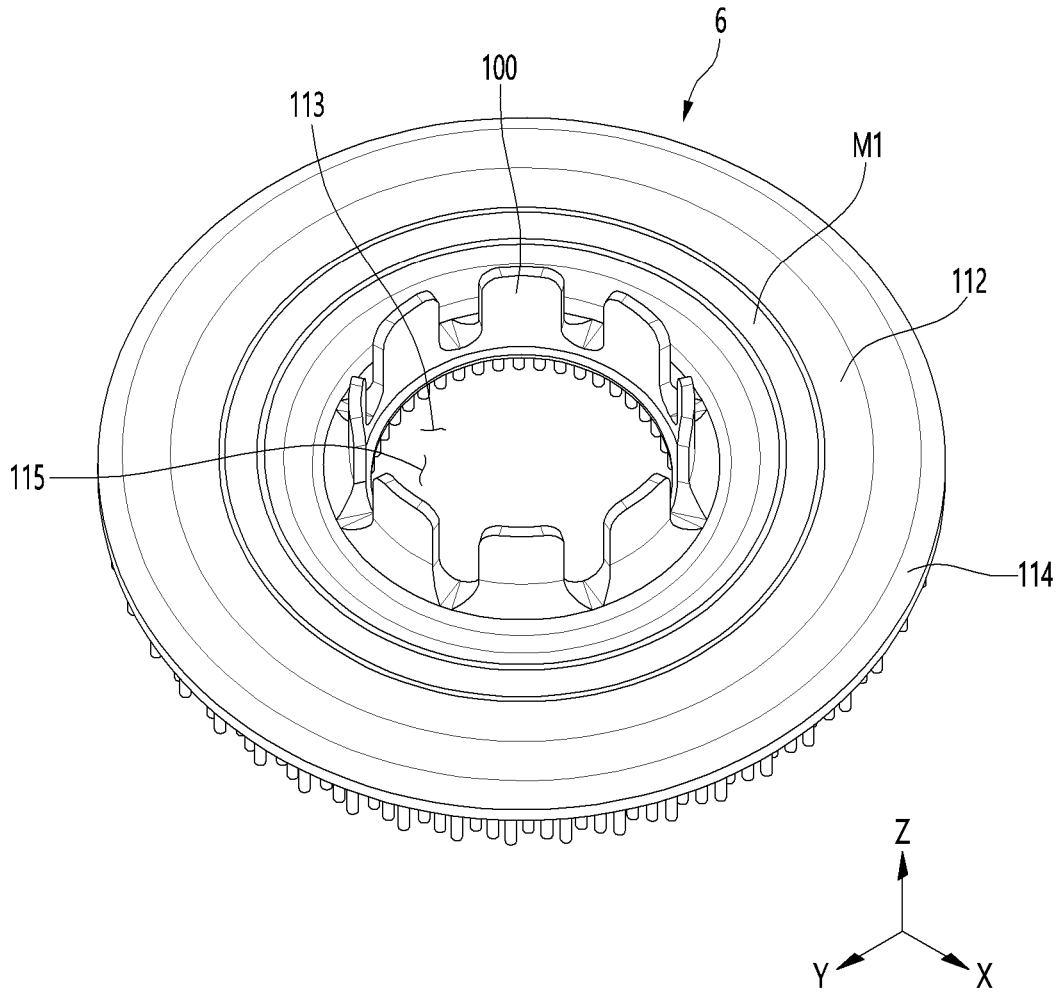
FIG. 8 is a view illustrating a cleaning brush according to the present embodiment.
Figure 9:
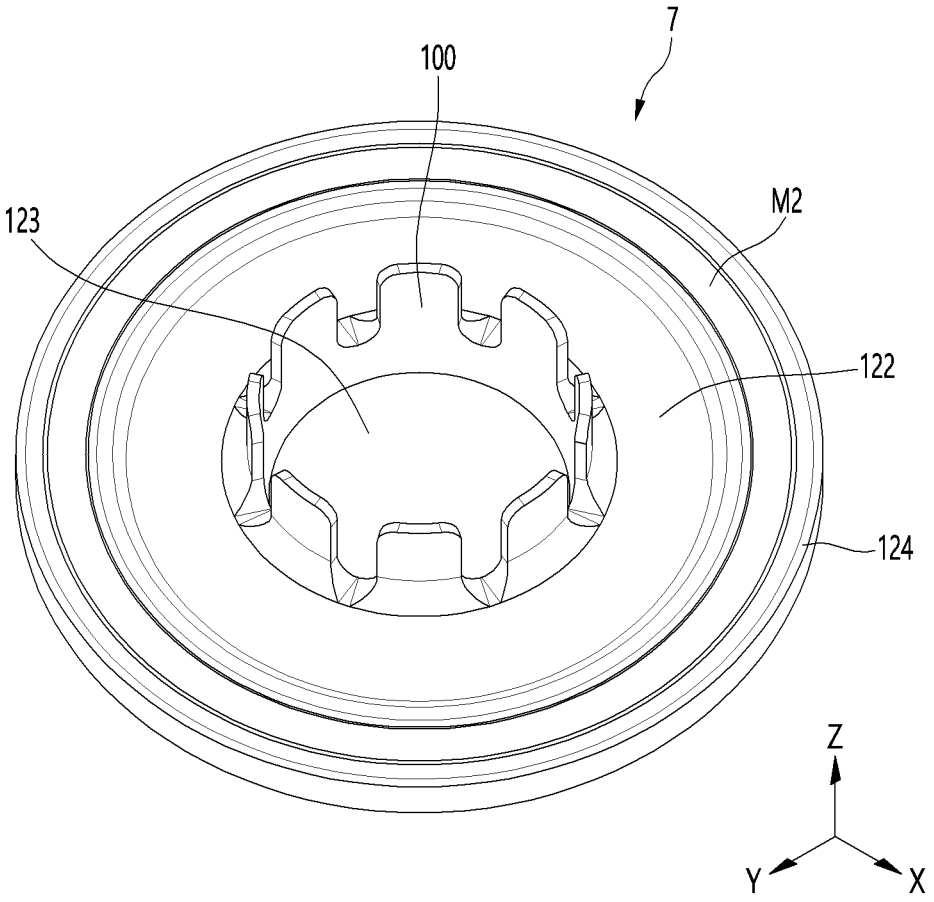
FIG. 9 is a view illustrating a regular bristle brush according to the present embodiment.
Figure 10:
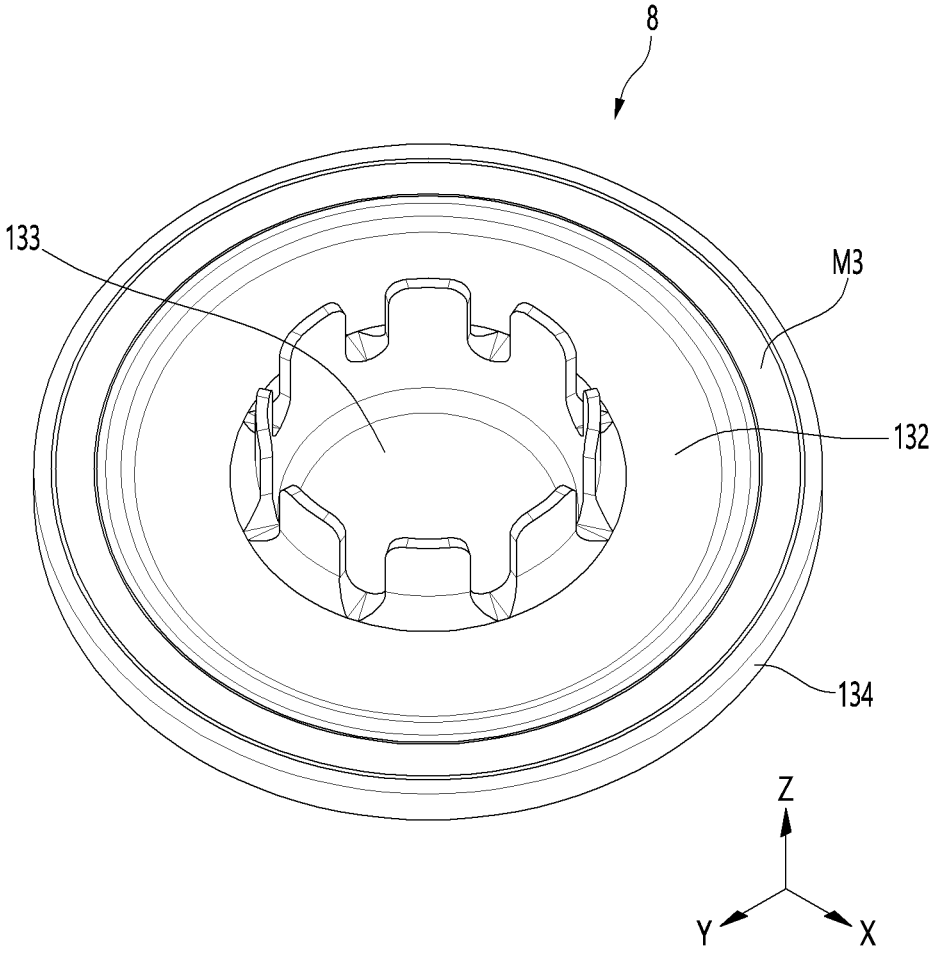
FIG. 10 is a view illustrating a glass brush according to the present embodiment.

FIG. 8 is a view illustrating a cleaning brush according to the present embodiment, FIG. 9 is a view illustrating a regular bristle brush according to the present embodiment, and FIG. 10 is a view illustrating a glass brush according to the present embodiment.

The plurality of brush units 6, 7, and 8 may include a cleaning brush 6, a regular bristle brush 7, and a glass brush 8.

The cleaning brush 6 includes a silicon brush 114, and openings 113 and 115 surrounding an outer periphery of the ultrasonic head 20 may be formed.

The cleaning brush 6 may include a brush bracket 112 on which a magnet M1 is disposed on the upper surface thereof and on which a coupling part 100 coupled to the rotor 60 is formed, and a silicone brush 114 covering the lower surface of the brush bracket 112. and openings 113 and 115 surrounding the outer peripheral surface of the ultrasonic head 20 may be formed in the center of the brush bracket 112 and the center of the silicon brush 114, respectively.

The silicon brush 114 may include a hollow disk-shaped body and a plurality of protrusions (or contact parts) protruding from a lower surface of the body.

The protrusion of the silicon brush 114 may have a substantially cylindrical shape or a polygonal column shape.

As described above, when the cleaning brush 6 is vibrated by the vibration motor 80, the cleaning brush may be useful for cleaning using bubbles.

The regular bristle brush 7 may include a fine bristle brush 124.

The regular bristle brush 7 may include a brush bracket 122 in which a magnet M2 is disposed on an upper surface and a coupling part 100 coupled to the rotor 60 is formed, and a fine bristle brush 124 covering the lower surface of the brush bracket 72, and the brush bracket 122 may cover the ultrasonic head 20.

The ultrasonic head shielding part 123 may be formed in the center of the brush bracket 122 of the regular bristle brush 7.

When the coupling part 100 of the regular bristle brush 7 is inserted into the holder 60 and fitted in the holder 60, the brush bracket 122 of the regular bristle brush 7 can cover the space between the ultrasonic head 20 and the first case 30, and the ultrasonic head shielding part 123 may shield the ultrasonic head 20 from the lower side of the ultrasonic head 20 to protect the ultrasonic head 20.

The fine bristle brush 124 may have a different material from the silicon brush 114 and the glass 134 to be described later. An example of the fine bristle brush 124 may be a polypropylene (PP) material.

The fine bristle brush 124 may include a disk-shaped body and a plurality of protrusions (or contact parts) protruding from the lower surface of the body.

The protrusion of the fine bristle brush 124 may have an approximately cylindrical shape or a polygonal column shape and the height of the protrusion of the fine bristle brush 124 may be lower than the height of the protrusion of the silicon brush 114. The thickness of the protrusion of the fine bristle brush 124 may be smaller than the thickness of the protrusion of the silicon brush 114.

As described above, when the regular bristle brush 7 is rotated, the regular bristle brush may rub against the skin to remove wastes or dead skin cells.

It is also possible to use the regular bristle brush 7 together with foam.

The glass brush 8 may include a glass 134.

The glass brush 8 may include a brush bracket 132 in which a magnet M3 is disposed on an upper surface and a coupling part 100 coupled to the rotor 60 is formed, and glass 134 covering the lower surface of the brush bracket 82 and having at least one of a groove part and a hole part formed thereon, and the brush bracket 132 may cover the ultrasonic head 20.

The ultrasonic head shielding part 133 may be formed in the center of the brush bracket 132 of the glass brush 8.

When the coupling part 100 of the glass brush 8 is inserted into the holder 60 and inserted into the holder 60, the brush bracket 132 of the glass brush 8 may cover a portion between the ultrasonic head 20 and the first case 30, and the ultrasonic head shielding part 133 may shield the ultrasonic head 20 from the lower side of the ultrasonic head 20 and protect the ultrasonic head 20.

A plurality of groove parts or hole parts may be formed in the glass 134, and the plurality of groove parts or hole parts may be finely formed in the glass 134 by etching. The glass 134 may be a friction plate or a friction pad having a high surface roughness due to a plurality of groove parts or hole parts.

As described above, when the glass brush 8 is rotated, the glass brush may rub against the skin to remove wastes or dead skin cells.

The glass 134 may be a friction plate having a large surface roughness, and when the glass 134 is rotated, it is possible to effectively remove dead skin cells from the user's heel.

The plurality of brush units 6, 7, and 8 may have the same formation position of the coupling part 100. The coupling parts 100 of the plurality of brush units 6, 7, and 8 may have the same size and shape.

The coupling part 100 of each of the plurality of brush units 6, 7, and 8 may be selectively inserted into the gap T.

The plurality of brush units 6, 7, and 8 may have different types of magnets M1, M2, and M3.

For example, the magnet M1 mounted on the brush bracket 112 of the cleaning brush 6 has an S pole magnetic force, and the magnet M2 mounted on the brush bracket 122 of the regular bristle brush 7 has a magnetic force in which a S pole and an N pole are mixed, and the magnet M3 mounted on the brush bracket 132 of the glass brush 8 may have an N pole magnetic force.

The sensor 90 illustrated in FIG. 6 may be a magnetic force detection sensor capable of detecting a magnetic force, or a Hall sensor capable of detecting an S pole and an N pole. An example of such a sensor 90 may be the LN4916. The types of the magnets M1, M2, and M3 can be sensed through the sensor 90, and the body cleanser 1 may be controlled differently according to the types of the sensed magnets M1, M2, and M3.

Figure 11:
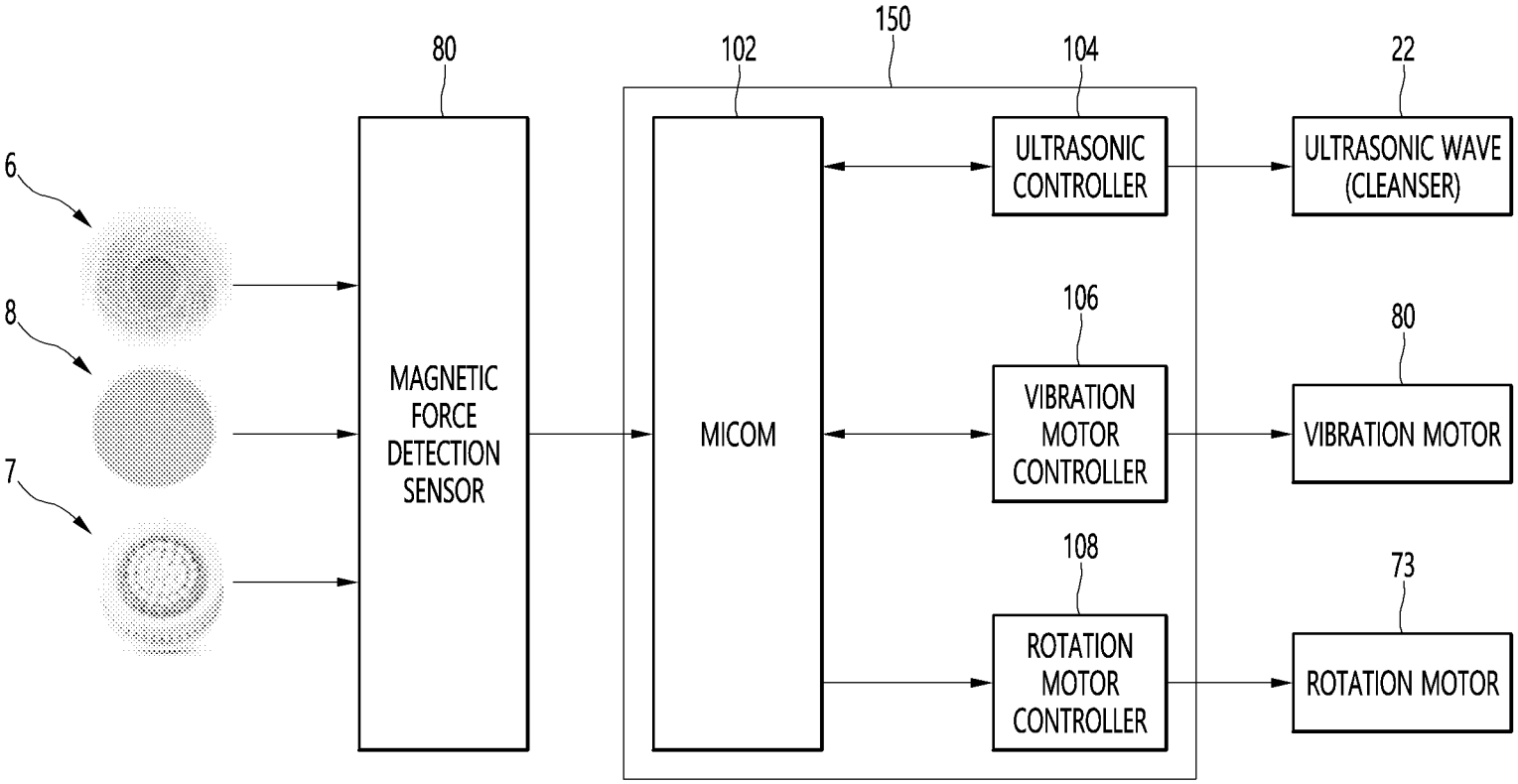
FIG. 11 is a control block diagram of the body cleanser according to the present embodiment.

FIG. 11 is a control block diagram of the body cleanser according to the present embodiment.

The body cleanser 1 may include a controller 150.

The controller 150 may control the overall operation of the body cleanser 1 and may include a microcomputer 102, an ultrasonic controller 104, a vibration motor controller 106, and a rotation motor controller 108.

The controller 150 may recognize the brush units 6, 7, and 8 mounted on the holder 60 according to the sensed value of the sensor 90, and can control the body cleanser 1, in particular, the ultrasonic vibrator 22, the vibration motor 80, and the rotation motor 73.

The microcomputer 102 may recognize which of the plurality of brush units 6, 7, and 8 is mounted according to a signal output from the sensor 90.

The microcomputer 102 may output a signal to the ultrasonic controller 104, the vibration motor controller 106, and the rotation motor controller 108 according to the recognition result.

An example of the ultrasonic controller 104 may be a circuit part capable of outputting a control signal of the ultrasonic vibrator 22 to the ultrasonic vibrator 22.

An example of the vibration motor controller 106 may be a circuit part capable of outputting a control signal of the vibration motor 80 to the vibration motor 80.

An example of the rotation motor controller 108 may be a circuit part capable of outputting a control signal of the rotation motor 73 to the rotation motor 73.

The controller 150 may operate the vibration motor 80 and the ultrasonic vibrator 22 when the cleaning brush 6 is mounted. In this case, the silicone brush 114 of the cleaning brush 6 can apply vibration and ultrasonic waves to the skin, and the user can deep clean the skin.

The controller 150 may operate the rotation motor 73 of the rotation mechanism 70 when the regular bristle brush 7 or the glass brush 8 is mounted. When the regular bristle brush 7 is mounted, the fine bristle brush 124 can be rotated to cleanly clean the user's elbows or the like.

When the glass brush 8 is mounted, the glass brush 8 can be rotated to remove dead skin cells from the user's heel.

The controller 150 may drive the rotation motor 73 for a first set time when the regular bristle brush 7 is mounted, and the controller may drive the rotation motor 73 for a second set time when the glass brush 8 is mounted, and the second set time may be longer than the first set time.

The above-disclosed subject matter is to be considered illustrative, and not restrictive, and the appended claims are intended to cover all such modifications, enhancements, and other implementations, which fall within the scope of the present disclosure.

Thus, the implementation of the present disclosure is to be considered illustrative, and not restrictive.

Therefore, the scope of the present disclosure is defined not by the detailed description of the invention but by the appended claims, and all differences within the scope will be construed as being included in the present disclosure.

What is claimed is:

1. A body cleanser comprising:

a case configured to form an accommodation space;

a bracket configured to be accommodated in the accommodation space;

a rotor configured to be rotatably disposed on the bracket;

a rotation mechanism configured to be accommodated in the accommodation space and to facilitate rotation of the rotor;

an ultrasonic head configured to be disposed on the bracket and having a ultrasonic vibrator;

a vibration motor configured to be accommodated in the accommodation space and to vibrate the bracket;

a plurality of brush units having a magnet disposed on a side facing the case, wherein each of the plurality of brush units is selectively disposed on the rotor; and a sensor configured to be accommodated in the accommodation space and to detect the magnet.

2. The body cleanser of claim 1, wherein the ultrasonic head comprises a head and a housing coupled to the head and having a space in which the ultrasonic vibrator is accommodated.

3. The body cleanser of claim 2, wherein the ultrasonic head further comprises a head sealing member configured to be disposed on at least one of the head or the housing to seal a space between the head and the housing.

4. The body cleanser of claim 2, wherein the ultrasonic head further comprises a housing sealing member configured to be disposed on the housing and to seal a space between the housing and the bracket.

5. The body cleanser of claim 2, further comprising:

a bracket sealing member configured to be disposed on the bracket to seal between a portion between the housing and the bracket.

6. The body cleanser of claim 1, wherein the case comprises:

a first case configured to face the plurality of brush units coupled to the rotor, a second case configured to be coupled to the first case and provided with a handle, and a case sealing member configured to be disposed on at least one of the first case or the bracket to seal a portion between the first case and the bracket.

7. The body cleanser of claim 1, wherein the rotation mechanism comprises:

a power transmission gear configured to be meshed with a driven gear formed on the rotor;

a rotation shaft coupled to the power transmission gear, and a rotation motor configured to rotate the power transmission gear, wherein the bracket has an opening for the rotation shaft to pass through, and wherein the body cleanser further comprises a rotation shaft sealing member disposed between the rotation shaft and the opening to seal a portion between the rotation shaft and the opening.

8. The body cleanser of claim 1, wherein the plurality of brush units comprises:

a brush bracket on which a coupling part coupled to the rotor is formed, and a silicone brush configured to cover a lower side of the brush bracket, wherein the magnet is disposed on an upper side of the brush bracket, and wherein a first and second opening respectively surrounding an outer peripheral surface of the ultrasonic head are formed at a center of the brush bracket and a center of a silicon brush, respectively.

9. The body cleanser of claim 1, wherein the plurality of brush units comprises:

a brush bracket on which a coupling part coupled to the rotor is formed, and which covers the ultrasonic head; and a fine bristle brush configured to cover a lower side of the brush bracket, wherein the magnet is disposed on an upper side of the brush bracket.

10. The body cleanser of claim 1, wherein the plurality of brush units comprises:

a brush bracket on which a coupling part coupled to the rotor is formed, and which covers the ultrasonic head; and a glass configured to cover a lower side of the brush bracket and having at least one of a groove part and a hole part formed thereon, wherein the magnet is disposed on an upper side of the brush bracket.

11. The body cleanser of claim 1, wherein the plurality of brush units have different types of magnets, and wherein the sensor is a hall sensor disposed on an inner surface of the case.

12. The body cleanser of claim 1, wherein the plurality of brush units comprises:

a cleaning brush having a silicone brush and having an opening surrounding an outer peripheral side of the ultrasonic head, a regular bristle brush having a fine bristle brush, and a glass brush having a glass.

* * * * *